US005485704A

United States Patent [19]

Sandor, Sr.

[11] Patent Number: 5,485,704

[45] Date of Patent: Jan. 23, 1996

[54] JOINING MEANS AND METHOD FOR CAST PANELS

[76] Inventor: Frederick J. Sandor, Sr., 407 St. George Ct., Satellite Beach, Fla. 32937

[21] Appl. No.: 240,258

[22] Filed: May 10, 1994

[51] Int. Cl.[6] ..... E04B 2/00

[52] U.S. Cl. ..... 52/584.1; 52/587.1; 403/294; 403/380

[58] Field of Search ..... 52/468, 584.1, 52/587.1, 250, 251, 583.1, 699; 403/293, 294, 380

[56] References Cited

U.S. PATENT DOCUMENTS

| | | | |
|---|---|---|---|
| 1,714,987 | 5/1929 | Pedersen | 52/250 |
| 2,312,489 | 3/1943 | Schaefer | 189/34 |
| 3,267,631 | 8/1966 | Hammitt | 52/584.1 X |
| 3,359,022 | 12/1967 | Russell | 52/468 X |
| 3,585,771 | 6/1971 | Pinniger | 52/251 |
| 3,621,626 | 11/1971 | Tylius | 52/227 |
| 3,744,826 | 7/1973 | Hawes | 52/468 X |
| 3,782,061 | 1/1974 | Minutoli | 52/251 X |
| 3,830,030 | 8/1974 | Yosida | 52/584 |
| 3,831,339 | 8/1974 | Piralli | 52/584.1 |
| 3,993,341 | 11/1976 | Bentley | 294/89 |
| 4,881,349 | 11/1989 | Brown et al. | 52/127.11 |
| 5,287,675 | 2/1994 | McGee | 52/468 X |

FOREIGN PATENT DOCUMENTS

| | | | |
|---|---|---|---|
| 352481 | 4/1961 | Switzerland | 52/468 |

*Primary Examiner*—Carl D. Friedman
*Assistant Examiner*—Beth A. Aubrey
*Attorney, Agent, or Firm*—John H. Crozier

[57] ABSTRACT

In a preferred embodiment, a system for joining first and second cast panels, including: first and second main structural members, cast into and extending along opposing, spaced apart edges of the first and second panels, respectively, and defining a cavity therebetween; a first locking member engagable with upper portions of each of the first and second structural members to secure the first and second panels against movement toward or away from one another; a second locking member engagable with medial portions of each of the first and second structural members; and a third locking member extending between the first and second locking members to draw the first and second locking members together and lock together the first and second panels.

18 Claims, 5 Drawing Sheets

JOINING MEANS AND METHOD FOR CAST PANELS

BACKGROUND OF THE INVENTION

1. Field of the Invention

The present invention relates to panels employed in building construction generally and, more particularly, but not by way of limitation, to novel joining means and method for cast panels.

2. Background Art

Prefabricated or cast-in-place concrete or composite-type panels are frequently used in building construction to form floors or other horizontal surfaces. Typically, such panels are adjacently placed in abutting, or nearly abutting relationship, on a grid of horizontal steel beams to form the horizontal surfaces. The voids between adjacent edges surfaces of panels are then partially, or wholly, filled with caulking compound.

A substantial problem with such construction methods is that one or more panels, having no positive interlocking means, are free to move substantially with respect to one or more other panels. Furthermore, the bare upper corners of the edge surfaces are vulnerable to spalling and breaking, thus creating an unaesthetic appearance.

Accordingly, it is a principal object of the present invention to provide means and method for joining cast panels that furnish positive interlocking of adjacent panels.

It is a further object of the invention to provide such means and method that furnish an aesthetic appearance.

It is another object of the invention to provide such means and method that prevents the spalling or cracking of upper corners of edge surfaces of the panels.

It is an additional object of the invention to provide such means that is economically manufactured.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing in a preferred embodiment, a system for joining first and second cast panels, comprising: first and second main structural members, cast into and extending along opposing, spaced apart edges of said first and second panels, respectively, and defining a cavity therebetween; a first locking member engagable with upper portions of each of said first and second structural members to secure said first and second panels against movement toward or away from one another; a second locking member engagable with medial portions of each of said first and second structural members; and a third locking member extending between said first and second locking members to draw said first and second locking members together and lock together said first and second panels.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
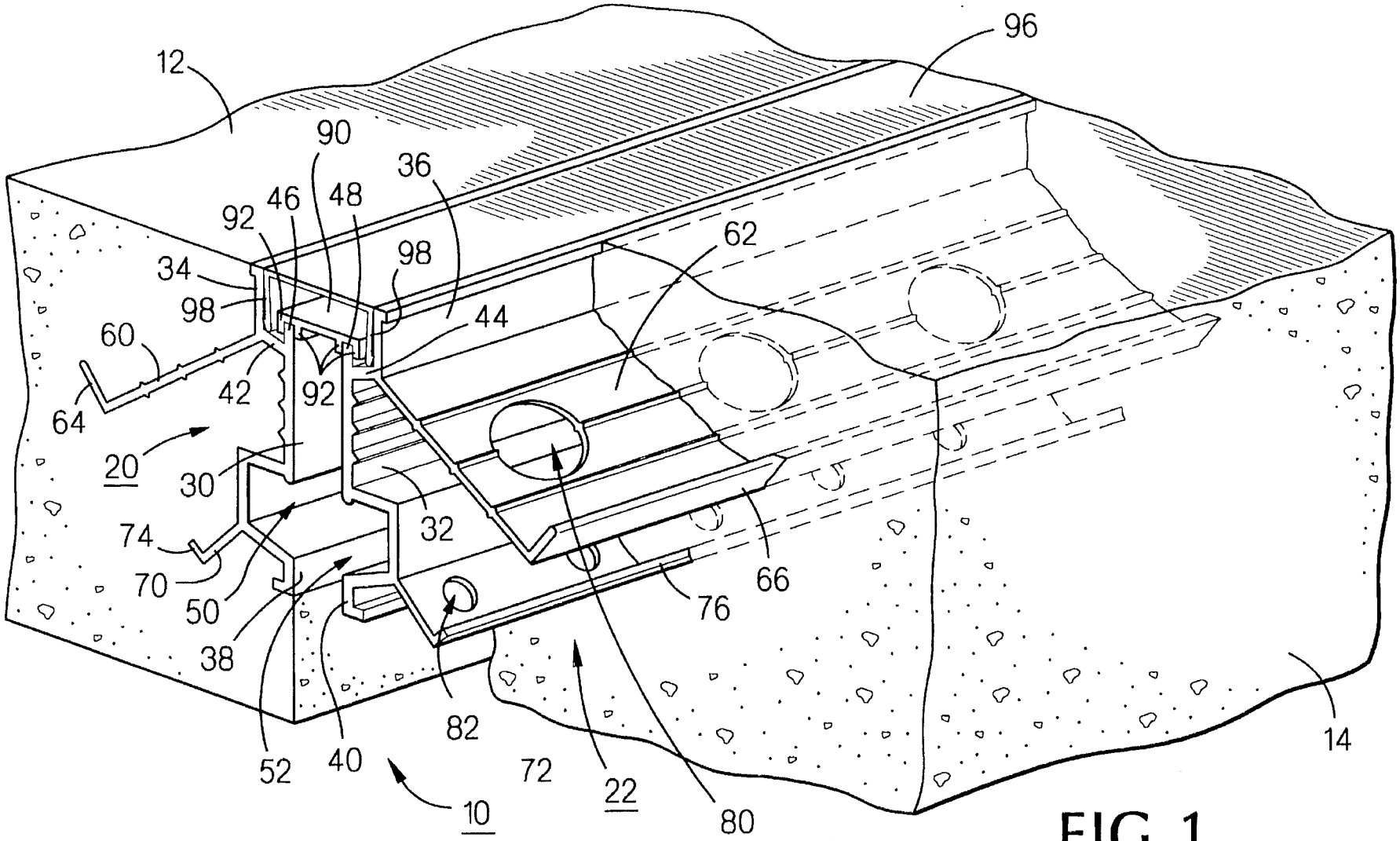
FIG. 1 is a fragmentary isometric view, partially cut-away, of a panel joining system according to a first embodiment of present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates the panel joining system of the present invention, generally indicated by the reference numeral 10, shown joining first and second panels 12 and 14. Panels 12 and 14 may be cast concrete panels or other composite-type panels. Panel joining system 10 includes two mirror-image, main structural elements, generally indicated by the reference numerals 20 and 22, cast into, and extending along opposing, spaced apart edges of panels 12 and 14, respectively. Structural elements 20 and 22 include, respectively, medial vertical walls 30 and 32, upper vertical walls 34 and 36, and lower vertical walls 38 and 40. Medial vertical walls 30 and 32 and upper vertical walls 34 and 36 are joined, respectively, by upwardly and outwardly extending joining walls 42 and 44. Two flanges 46 and 48 are formed, respectively, as vertical extensions of medial vertical walls 30 and 32 and extend somewhat above the upper surfaces of joining walls 42 and 44. Medial vertical walls 30 and 32 and lower vertical walls 38 and 40 are joined, respectively, by channels 50 and 52 formed therebetween and extending into panels 12 and 14.

Extending downwardly and outwardly, respectively, from the junctions of joining walls 42 and 44 and upper walls 34 and 36 are two, main anchoring arms 60 and 62. The distal ends of main anchoring arms 60 and 62 have, respectively, flanges 64 and 66 extending upwardly at 90 degrees from the edges thereof. Extending downwardly and outwardly, respectively, from the lower, external distal edges of channels 50 and 52 are two, secondary anchoring arms 70 and 72, having, respectively, flanges 74 and 76 extending upwardly at 90 degrees from the distal edges thereof. Anchoring arms 60, 62, 70, and 72 extend into panels 12 and 14 well away from the surfaces thereof to minimize the possibility of fracturing of the panels. Anchoring arms 60 and 62 have a plurality of apertures, as at 80, defined therethrough, and anchoring arms 70 and 72 have a plurality of apertures, as at 82, defined therethrough, the purpose of the apertures being to ensure that the anchoring arms are well locked into the material of panels 12 and 14 and become integral elements thereof.

A horizontally extending locking cap 90 has four, spaced apart vertical flanges 92 which engage flanges 46 and 48, thus locking together panels 12 and 14. A horizontally extending, upper sealing cap 96, generally flush with the upper surfaces of panels 12 and 14 extends over the upper space defined between structural members 20 and 22 and is held therein by the engagement of two flanges 98 depending from the distal edges of the sealing cap and engaging the inner surfaces of upper vertical walls 34 and 36. Having upper vertical walls 34 and 36 extend to the upper surfaces of panels 12 and 14 protects the upper corners of the panels from spalling or cracking.

Ribs, as at 100, formed on structural members 12 and 14 offer some structural rigidity and/or anchoring enhancement; however, their presence is due primarily to conventional considerations in designing the structural members for manufacture by extrusion.

Figure 2:
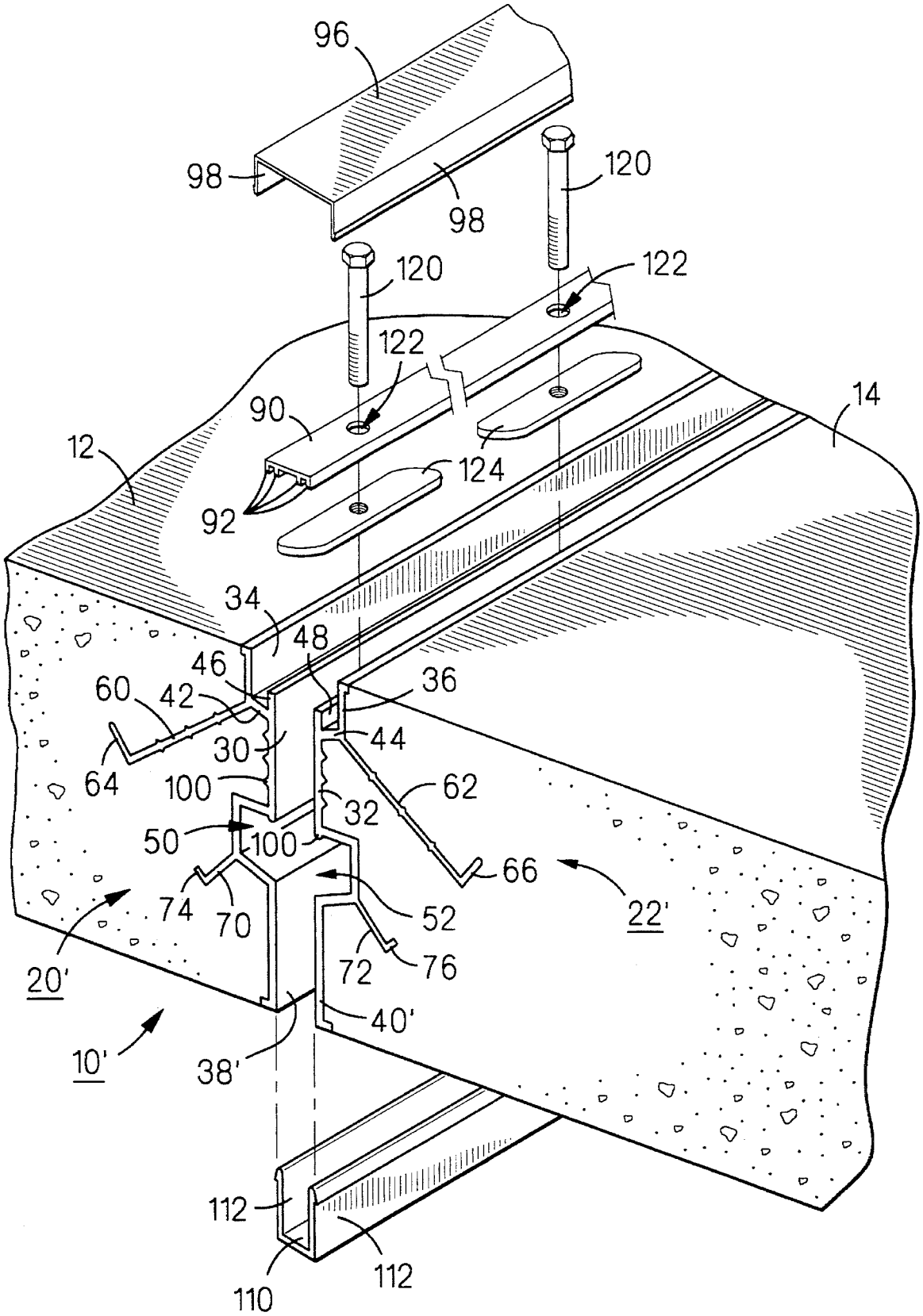
FIG. 2 is a fragmentary, exploded isometric view illustrating the locking means of the panel joining system applied to a second embodiment of the present invention.

FIG. 2 illustrates a variation of panel joining system 10 (FIG. 1), here generally indicated by the reference numeral 10'. System 10' varies from system 10 in that lower vertical walls 38' and 40' of structural members 20' and 22' extend to the lower surfaces of panels 12 and 14. This protects the lower corners of panels 12 and 14 and permits the insertion therebetween of a lower sealing cap 110 which is held in place by the engagement of upwardly extending flanges 112 with the inner surfaces of lower vertical walls 38' and 40'. This arrangement is desirable in installations in which the lower surfaces of panels 12 and 14 are exposed.

Figure 3:
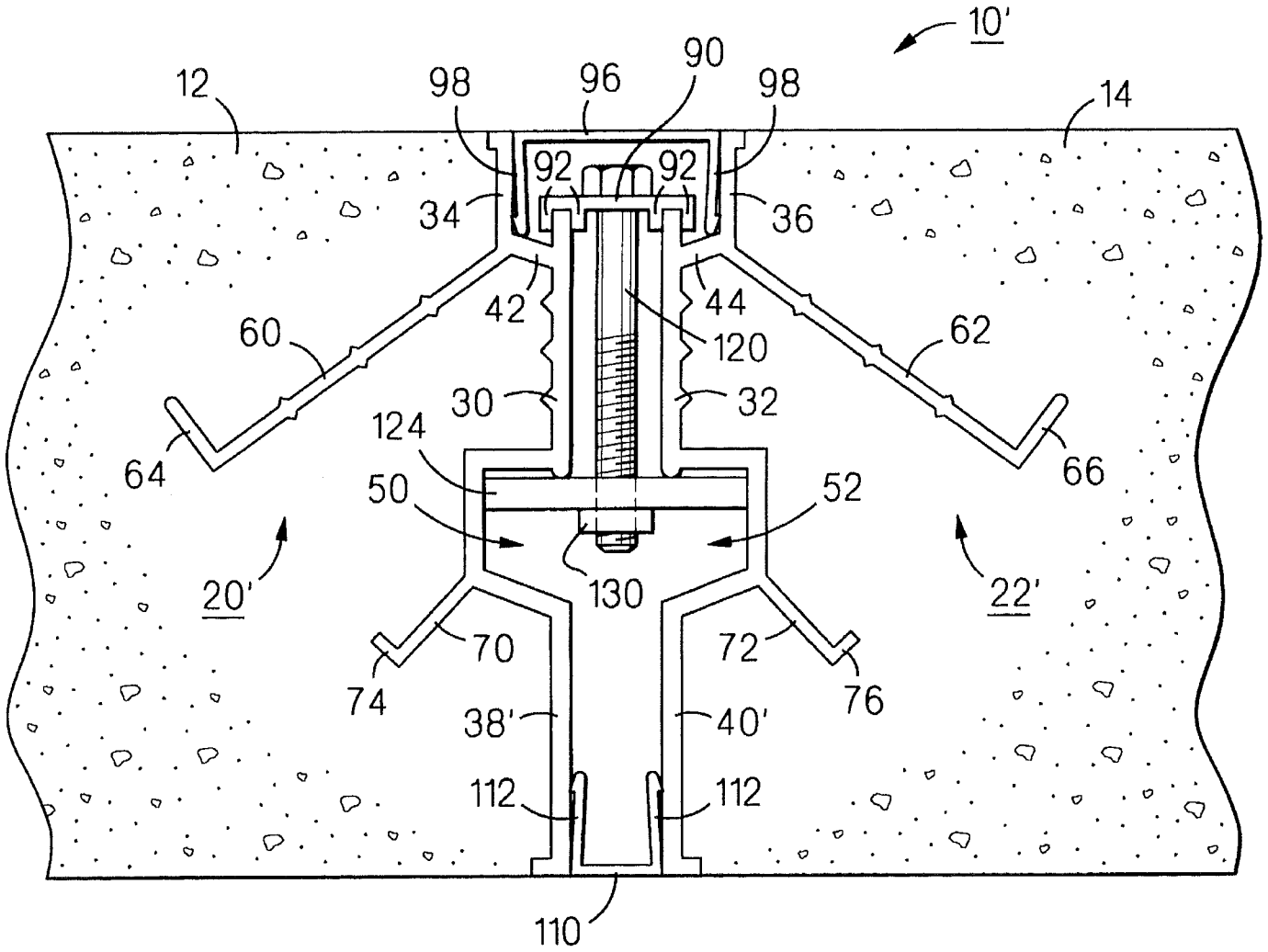
FIG. 3 is an end elevational view of the second embodiment of the panel joining system.

FIG. 2 also illustrates the means by which locking cap 90 is secured in place. A plurality of threaded screws 120 extend through holes 122 defined through locking cap 90 to threadingly engage locking lugs 124. After insertion of the aforementioned elements between structural members 20' and 22', locking lugs 124 are rotated 90 degrees to the positions shown on FIG. 3 and screws 120 further advanced through threaded inserts 130 attached to the lower surfaces of the locking lugs to tightly secure locking cap 90 to flanges 46 and 48 and join together the structural members.

Figure 4:
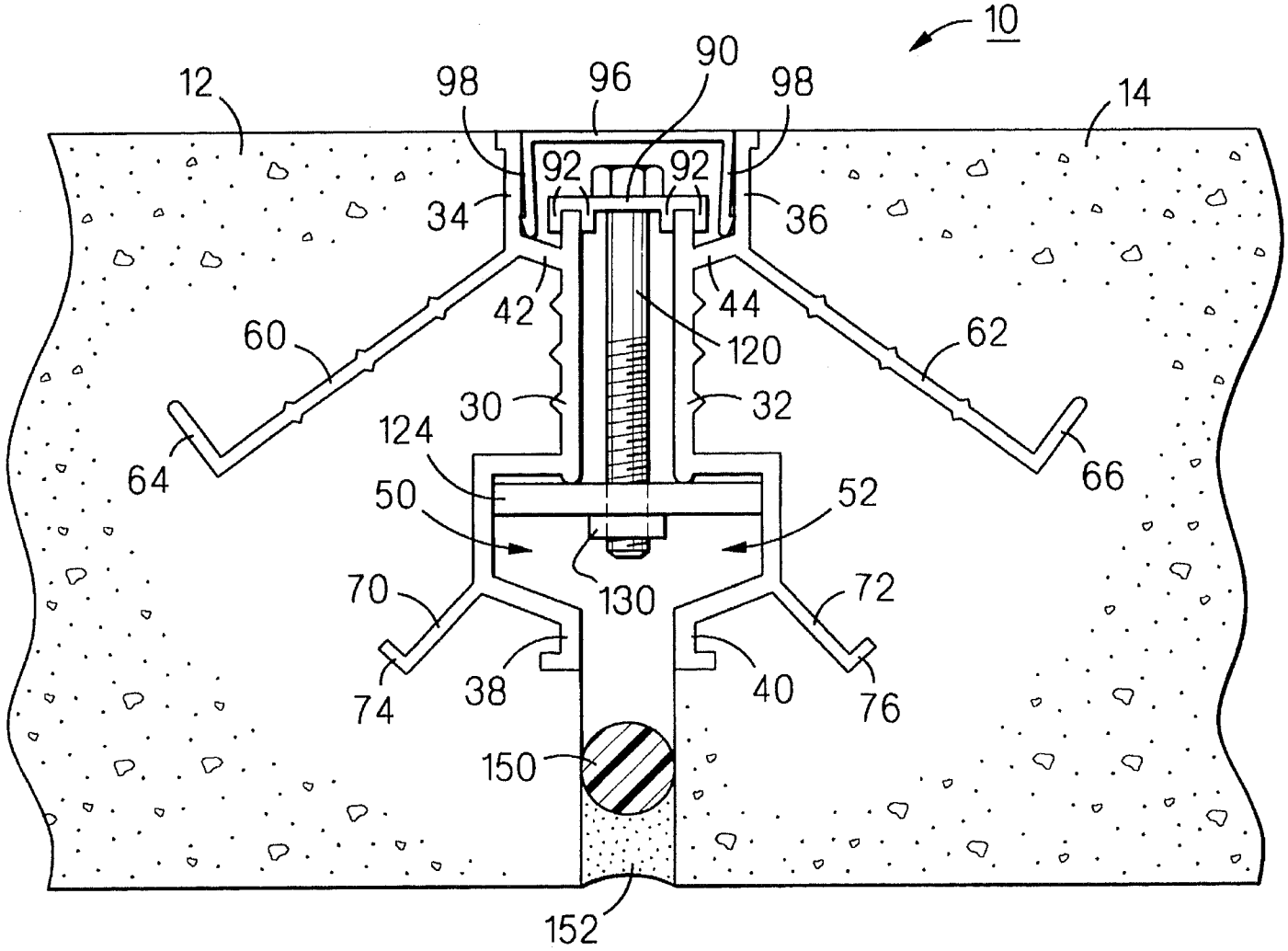
FIG. 4 is an end elevational view of the first embodiment of the panel joining system.

FIG. 4 illustrates a technique for sealing the lower portion of the cavity defined between panels 12 and 14 when joining system 10 (FIG. 1) is employed. Here, a bond breaker 150 is inserted into the cavity somewhat inwardly from the lower surfaces of panels 12 and 14. Then, a bead of caulking material 152 is placed between the lower surfaces of panels 12 and 14 and bond breaker 152, sealing the cavity.

Figure 5:
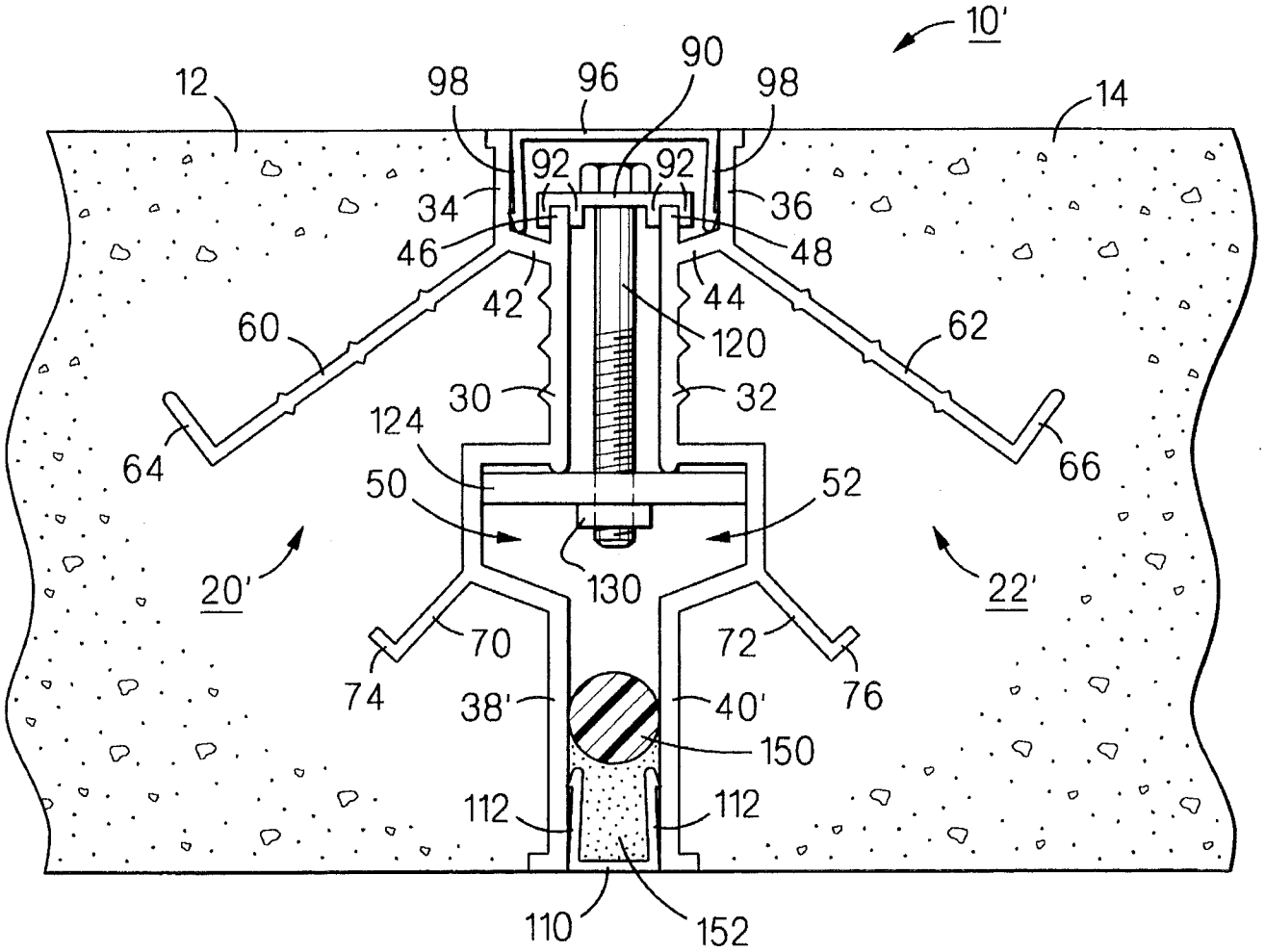
FIG. 5 is an end elevational view of the second embodiment of the panel joining system.

FIG. 5 illustrates a technique for sealing the lower portion of the cavity defined between panels 12 and 14 when joining system 10' (FIG. 2) is employed. Here, both lower trim cap 110 and bond breaker 150 with caulking 152 are employed to provide both sealing and an aesthetic appearance. Similarly, caulking may be placed in the upper portion of the cavity defined between panels 12 and 14 underneath upper sealing cap 96.

Figure 6:
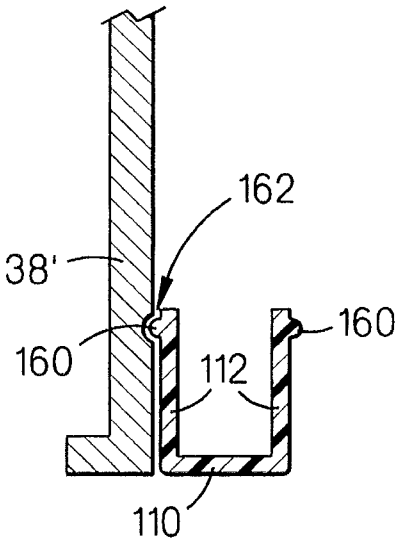
FIG. 6 is an enlarged, end elevational view, in cross-section, of a detail of the panel joining system.

FIG. 6 illustrates the means by which lower trim cap 110 is held in the lower portion of the cavity defined between panels 12 and 14. Formed on the distal ends of flanges 112 are outwardly facing ridges 160 which engage complementarily formed grooves defined in the inner surfaces of lower vertical walls 38' and 40' (only 38' shown).

With a grid of panels 12 and 14 locked together according to the present invention, the grid behaves as a single panel and relative movement between panels is greatly limited. The locking system compensates, to some extent, for imprecisely placed supporting steel members. The finished margins of the panels have an aesthetic appearance and the edge corners of the panels are protected against spalling and cracking.

Structural members 20, 20', 22, and 22' are preferably formed from a suitable metallic material by conventional extrusion techniques.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A system for joining first and second cast panels, comprising:

(a) first and second main structural members, cast into and extending along opposing, spaced apart edges of said first and second panels, respectively, and defining a cavity therebetween;

(b) a first locking member engagable with upper portions of each of said first and second main structural members to secure said first and second panels against movement toward or away from one another;

(c) a second locking member engagable with medial portions of each of said first and second main structural members; and (d) a third locking member extending between said first and second locking members to draw said first and second locking members together and lock together said first and second panels.

2. A system, as defined in claim 1, wherein: said second locking member is disposed so as to secure said first and second panels against movement toward each other.

3. A system, as defined in claim 1, wherein: said first and second main structural members have main anchoring arms extending into said first and second cast panels, respectively, and terminating well away from surfaces of said first and second panels.

4. A system, as defined in claim 1, wherein: said first and second main structural members extend fully the thickness of said first and second panels.

5. A system, as defined in claim 1, wherein: said first and second main structural members extend less than fully the thickness of said first and second panels.

6. A system, as defined in claim 1, wherein: said first locking member is a locking cap including a plate portion extending along and between said first and second main structural members and having four flanges depending therefrom to form first and second channels, said first and second channels closely fitting around said upper portions of said first and second main structural members, respectively, said upper portions comprising complementarily dimensioned flanges formed on said main structural members.

7. A system, as defined in claim 1, wherein: said second locking member comprises a locking tab rotatable into first and second channels formed in said first and second main structural members, respectively, ends of said locking tab engaging bottoms of said channels when said locking tab is in place.

8. A system, as defined in claim 7, wherein: said third locking member comprises a threaded fastener extending between said first locking member and said locking tab so as to tighten said locking tab against walls of said first and second channels.

9. A system, as defined in claim 1, further comprising: a first trim cap covering said cavity near said first locking means and generally flush with first surfaces of said first and second panels.

10. A system, as defined in claim 9, further comprising: a second trim cap covering said cavity away from said first locking means and generally flush with second surfaces of said first and second panels.

11. A method for joining first and second cast panels, comprising:

(a) providing first and second main structural members, cast into and extending along opposing, spaced apart edges of said first and second panels, respectively, and defining a cavity therebetween;

(b) providing a first locking member engagable with upper portions of each of said first and second main structural members to secure said first and second panels against movement toward or away from one another;

(c) providing a second locking member engagable with medial portions of each of said first and second main structural members;

(d) providing a third locking member extending between said first and second locking members to draw said first and second locking members together and lock together said first and second panels; and (e) inserting said first, second, and third locking members into said cavity and drawing said first and second locking members together to lock together said first and second panels.

12. A method, as defined in claim 11, further comprising: disposing said second locking member so as to secure said first and second panels against movement toward each other.

13. A method, as defined in claim 11, further comprising: providing said first and second main structural members with main anchoring arms extending into said first and second cast panels, respectively, and terminating well away from surfaces of said first and second panels.

14. A method, as defined in claim 11, further comprising: providing said first and second main structural members extending fully the thickness of said first and second panels.

15. A method, as defined in claim 11, further comprising: providing said first and second main structural members extending less than fully the thickness of said first and second panels.

16. A method, as defined in claim 11, further comprising: providing said first locking member as a locking cap including a plate portion extending along and between said first and second main structural members and having four flanges depending therefrom to form first and second channels, said first and second channels closely fitting around said upper portions of said first and second main structural members, respectively, said upper portion being provided as flanges formed on said main structural members.

17. A method, as defined in claim 11, further comprising: providing said second locking member including a locking tab rotatable into first and second channels formed in said first and second main structural members, respectively, ends of said locking tab engaging bottoms of said channels when said locking tab is in place.

18. A method, as defined in claim 17, further comprising: providing said third locking member as a threaded fastener extending between said first locking member and said locking tab so as to tighten said locking tab against walls of said first and second channels.

* * * * *